United States Patent [19]

Danley

[11] Patent Number: 4,845,759

[45] Date of Patent: Jul. 4, 1989

[54] SOUND SOURCE HAVING A PLURALITY OF DRIVERS OPERATING FROM A VIRTUAL POINT

[75] Inventor: Thomas J. Danley, Highland Park, Ill.

[73] Assignee: Intersonics Incorporated, Northbrook, Ill.

[21] Appl. No.: 170,099

[22] Filed: Mar. 11, 1988

Related U.S. Application Data

[63] Continuation of Ser. No. 855,941, Apr. 25, 1986, abandoned.

[51] Int. Cl.[4] ..... G10K 11/00

[52] U.S. Cl. ..... 381/97; 381/156; 181/187

[58] Field of Search ..... 381/24, 89, 97, 111, 381/156; 181/187, 188

[56] References Cited

U.S. PATENT DOCUMENTS 1,951,692 3/1934 Evens ..... 179/115.5 PS
3,125,181 3/1964 Pawlowski ..... 381/89
4,015,089 3/1977 Ishii et al. ..... 381/89
4,554,414 11/1985 House ..... 179/115.5 PS
4,578,809 3/1986 Eberbach ..... 381/24

FOREIGN PATENT DOCUMENTS 52-33517 3/1977 Japan ..... 381/97

OTHER PUBLICATIONS

Tremaine, Audio Cyclopedia, 1979, p. 1099, FIG. 20–54.

*Primary Examiner*—Forester W. Isen
*Attorney, Agent, or Firm*—Juettner Pyle Lloyd & Verbeck

[57] ABSTRACT

A sound source includes a plurality of drivers communicating with the common throat of a horn. The size of the radiating area of the throat is less than two or three wavelengths of the highest frequency to be produced such that the drivers operate conjointly from a virtual point. Means may be included to adjust the time delay or phase between drivers to control the dispersion angle.

2 Claims, 2 Drawing Sheets

SOUND SOURCE HAVING A PLURALITY OF DRIVERS OPERATING FROM A VIRTUAL POINT

This is a of co-pending application Ser. No. 06/855,941 filed on Apr. 25, 1986 now abandoned.

BACKGROUND OF THE INVENTION

This invention relates to sound sources and more particularly to an apparatus for producing a wide band of intensified sound having controllable dispersion characteristics.

In order to produce voice and music sound in large areas, various techniques are employed for generating a high ratio of direct to reflected sound. One technique is to employ a large cluster of speakers having individual drives at a central location, with two locations being used to create stereophonic effects. Another technique is to use multiple locations, with phase delays to the outlying speakers. The latter approach usually results in the generation of large quantities of reflected sound. The use of single locations, while being preferred, requires the use of a large number of relatively expensive individual speakers. Also, the dispersion characteristics to the individual speakers must be taken into consideration to obtain uniform coverage, and this is not always easily accomplished. The individual speakers interfere with each other because their acoustic inputs combine at a point where they are physically too large. As a result, the radiation pattern is distorted or uneven, even though the sound pressure levels are adequate to cover the area.

SUMMARY OF THE INVENTION

The present invention provides an improved sound source comprising a plurality of electroacoustical drivers or sound radiating means acting together as a single source. The sound radiating portion of each driver has an effective size of less than one to several wavelengths at the highest frequency to be produced, such that the drivers act together substantially as a virtual point source, permitting mutual reinforcement. The drives are closely spaced along the line such that the dispersion patterns of adjacent sources complement each other. The drives are preferably mounted at the throat of a common horn. Dispersion characteristics are easily controlled by time delay or phase adjustments along or within the line.

The multiple point sound source of the present invention offers many advantages over the use of multiple speakers or horns which do not operate as point sources. Power handling capacity is greatly improved. In addition, the effective sensitivity is increased because of the decreased radiation angle or higher directivity of each individual driver in the series. As a result, for example, a four driver point source unit which is horn loaded constitutes the equivalent of six to eight individual horns having individual drives. Greater efficiencies are realized as the number of point source drivers are increased. In addition, the dispersion characteristics of the point/line source may be easily adjusted to accommodate any given area.

THE DRAWINGS

DESCRIPTION OF THE PREFERRED EMBODIMENTS

Figure 1:
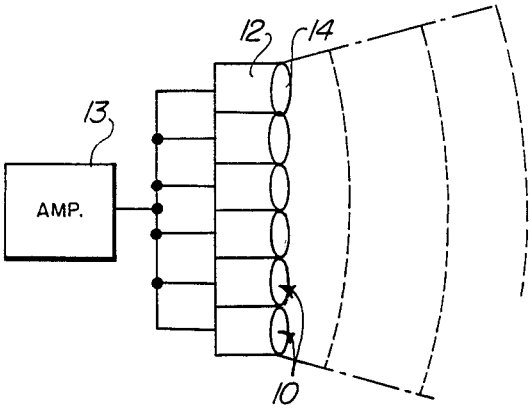
FIGS. 1, 2 and 3 are schematic views of a simplified sound source of the present invention.
Figure 2:
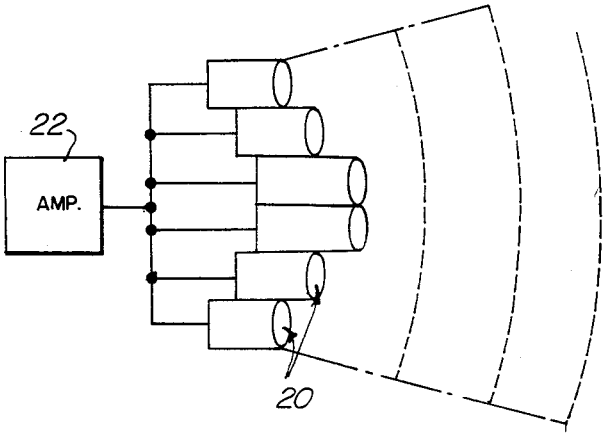
Figure 3:
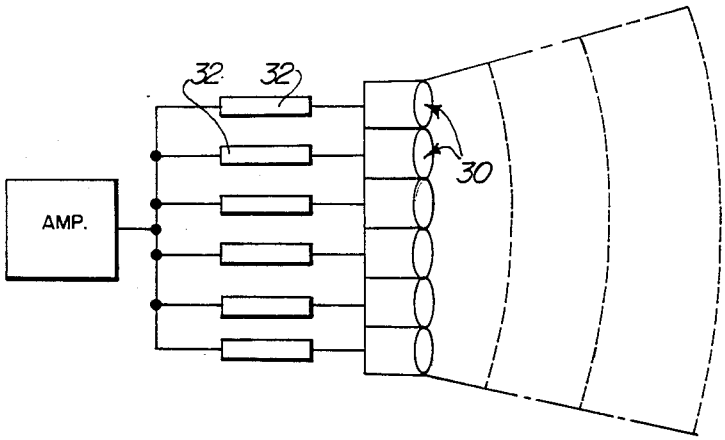

FIGS. 1–3 show high simplified versions of the sound source of the present invention. As shown in FIG. 1, plurality of drives or sound transducers 10 are arranged in a line and connected to a common input 13 of amplified audio signal power for driving the sources together over a given band of frequencies, for example, within the range of audible hearing. The sound sources 10 are conventional in nature and may include a conventional vibrating electro-mechanical drive 12 coupled to a sound radiator 14, with all of the radiators facing in the same direction.

The arrangement of the present invention differs in several respects from similar prior art devices. The size or working surface diameter of the individual sound radiators in a direction perpendicular to the line is less than one wavelength of sound to be produced over the desired band of frequencies. Thus, the size of each radiator would be less than one wavelength of sound at the highest frequency to be produced. As a result, the individual sources act as point sources on a line with a high degree of dispersion, typically greater than 90 degrees. If the size of the source is approximately one wavelength, the −6 dB angle of dispersion is approximately 90°. This angle increases as the effective size is decreased.

In addition, the effective size and spacing between the sound sources along the line is also critical. The spacing and effective size in this direction must be such as to allow adjacent sound dispersion patterns to overlap and complement each other. Thus, the effective size of the source in this direction is preferably less than several, or 2 to 3 wavelengths of the highest frequency to be produced, depending on the number of sources employed and the desired radiation angle. Also the sources are spaced closely together, with the distance between adjacent centers of the sources being less than several wavelengths at the highest frequency. As a result, the sources act together as if they were a single more powerful and larger source. For every doubling of sources, the power output is raised by 6 dB, or a 3 dB gain in efficiency and a 3 dB gain in power capacity. The same would not be true if the sources 10 were operated as separate sources because no significant change in efficiency would occur.

In the arrangement shown in FIG. 1, the sound sources 10 are identical and are arranged in a straight vertical line, and the dispersion pattern is represented by dotted lines. In such arrangement, the vertical dispersion shown is controlled by the height of the line versus the frequency being produced.

In order to alter the dispersion pattern, several alternatives are available. Rather than having a straight line, as shown in FIG. 1, the line may be cured or staggered. As shown in FIG. 2, the sources 20 are on a line which curves or angles away from a central location, thus increasing the vertical angle of dispersion. Whereas the sources 20 are driven in phase by a common input 22, the phase of the outer sources is delayed because of the rearward spacing.

Figure 6:
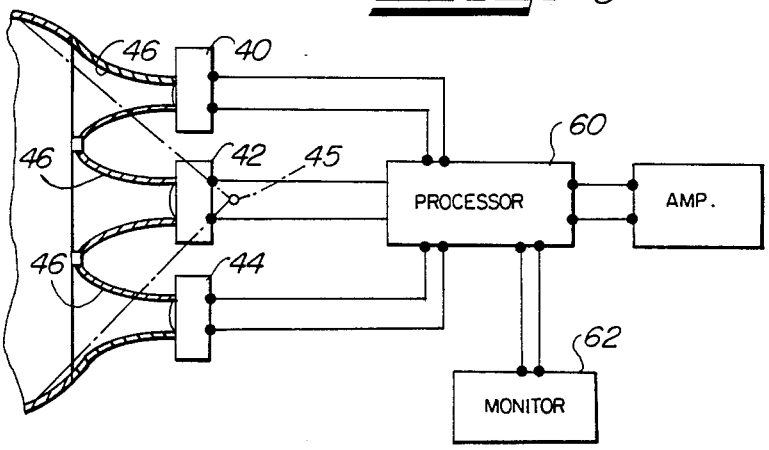
FIG. 6 is a sectional view taken along line 6—6 of FIG. 4.

As shown in FIG. 3, each source or selected source 30 may be connected to a phase control unit 32. This allows the dispersions pattern of portions of or the entire line source to be adjustable over a wide range in order to accommodate various areas of coverage and other variables in the listening area. Thus, it is possible to shape the acoustic dispersion pattern to accommodate the peculiarities of a particular listening environment. For example, as shown in FIG. 6, the phase control may be in the form of a digital or analog processor 60 connected to a monitor 62 such as a microphone located at various parts of the listening area. Thus, the sound intensity level at various locations could be fed into the processor to adjust the phase of the sources to assure uniform sound levels throughout the listening area. Additional sound could be focused on relatively dead areas of the listening area.

Since the amount of acoustic power obtainable is directly related to the radiating area of the device and the intensity, which is limited by driver construction, it is preferable to increase the effective radiating area over that which is shown in FIGS. 1-3. One convenient method of accomplishing this result is by horn loading, an example of which is described hereinafter.

Figure 4:
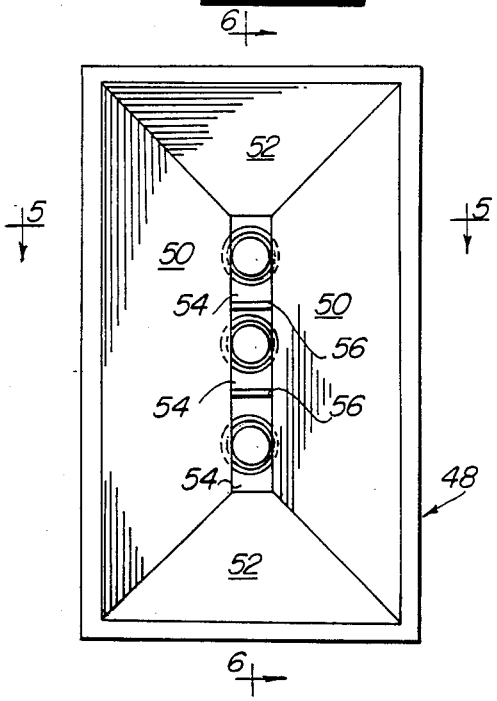
FIG. 4 is a front view of a horn associated with the sound source of the present invention.
Figure 5:
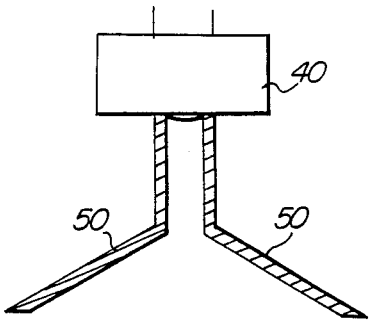
FIG. 5 is a sectional view taken along line 5—5 of FIG. 4.

As shown in FIGS. 4, 5 and 6, the line of sound sources may be arranged in the throat of a single horn. Various types of horns are available, including exponential horns and constant directivity horns. Various horns are shown and described in the following U.S. Pat. Nos.: 2,537,141; 4,071,112; 4,187,926; and 4,390,078.

As shown, a plurality of drivers such as 40, 42 and 44 are connected via respective throats 46 to a common horn, generally indicated at 48. The horn 48 has a pair of outwardly diverging side walls 50 connected to end walls 52. In the embodiment shown, the end walls 52 also diverge outwardly from the throat area.

At the entrance to the horn 48, the individual throats 46 unite or combine in a number of slots 54 or other restricted openings. In the embodiment shown, the slots 54 are elongated vertically and are separated by walls 56. The horizontal width of each slot is preferably less than one wavelength of the highest frequency to be produced, or is a size which permits the desired dispersion at such frequency. As a result, the sources act together as a virtual point source. The spacing between slots and the height of the slots are at values to that the radiation pattern from a given slot will overlap the radiation pattern of its adjacent slot or slots.

As illustrated in FIG. 6, the critical radiation area and/or size of the drivers relative to the frequency allow the drivers 40, 42 and 44 to operate conjointly from a virtual point 45 located rearwardly from the horn throat. If the size-frequency relation is not attained, the drivers would operate separately and interfere with each other. In the present invention, the wave fronts of sources are summed or combined in a restricted area where the dimensions are small relative to the wavelength or frequency.

As a particular example of the foregoing, a horn with four drivers operating up to a frequency of 20 KHz with 90° dispersion would require a sloth width of less than one wavelength or 0.675 inches. If a 40 degree vertical dispersion is required, then the length and spacing between slots would be such that the angle of dispersion at 20 KHz would be greater than 10 degrees each. In the horizontal direction, the primary angle of dispersion would be controlled by the angle of the horn walls. In typical sound reproduction systems a typical horizontal dispersion would be 70 to 90 degrees and a typical vertical dispersion would be 30 to 50 degrees. It is well within the purview of one skilled in the art to design a horn structure to accommodate the plurality of point sound sources of the present invention, depending on the horizontal and vertical dispersion characteristics which may be required.

While the embodiments described herein show the sound sources arranged on a vertical line, very obviously other arrangements are possible, including curved lines, horizontal lines, angular, and combinations thereof, depending on the dispersion characteristics required in a particular environment.

I claim:

1. A sound source comprising a horn, said horn comprising an open mouth extending from a throat having a size smaller than the mouth, a plurality of separate identical sound transducers connected to and communicating through separate openings with the throat of said horn, said transducers being arranged along a line, means for operating said transducers together in a given frequency range, the size of said openings perpendicular to said line being less than two to three wavelengths of the highest frequency to be produced, whereby said transducers act together as a virtual point source, and means for controlling the time delay between said transducers to control the sound dispersion angle.

2. The sound source of claim 1 wherein the spacing between adjacent transducers is such that the dispersion patterns of adjacent drivers overlap.

* * * * *